US005271305A

United States Patent [19]

Peters et al.

[11] Patent Number: 5,271,305

[45] Date of Patent: Dec. 21, 1993

[54] BASE AND CLAMPING BAR ASSEMBLY

[75] Inventors: Alan R. Peters, Cape Coral, Fla.; Vincent T. Kozyrski, Plainville, Conn.

[73] Assignee: The Fletcher-Terry Company, Farmington, Conn.

[21] Appl. No.: 889,040

[22] Filed: May 26, 1992

[51] Int. Cl.[5] ..... B26D 1/04; B26D 3/02

[52] U.S. Cl. ..... 83/455; 33/32.1; 33/443; 33/447; 83/578; 83/581; 83/614; 83/700; 403/107; 403/373

[58] Field of Search ..... 83/455, 614, 578, 635, 83/581, 700, 829; 403/106, 107, 80, 373; 33/443, 445, 447, 32.1

[56] References Cited

U.S. PATENT DOCUMENTS 1,208,266 12/1916 Beaumont ..... 33/447
1,977,213 10/1934 Slobey ..... 33/445
2,065,380 12/1936 Lamson ..... 83/455
2,784,493 3/1957 Tufts ..... 33/445
3,025,604 3/1962 Shelly ..... 33/447
4,038,751 8/1977 Albright ..... 30/293
4,366,626 1/1983 Livick ..... 33/443 X
4,831,739 5/1989 Davidson ..... 33/427
4,871,156 10/1989 Kozyski ..... 83/455 X

*Primary Examiner*—Hien H. Phan
*Assistant Examiner*—Kenneth E. Peterson
*Attorney, Agent, or Firm*—Ira S. Dorman

[57] ABSTRACT

A support assembly includes a base having end edges along which extend toothed racks for engagement of a clamping bar having meshing detents on its end portions, the clamping bar providing a guide track for a DIY mat cutter. The base is invertible to present English system and metric system distance-measuring features on its opposite side surfaces.

22 Claims, 12 Drawing Sheets 10
12
14
16
20
23
26
28
29
32
38
40
41
62
72
74"
86
88
90
91
102
104
106
108
120
124
130
132
134
139
143
144
146
150
154
204
206
208
214
218
5
6
7
1
2

94
154
156
158

FIG. 13
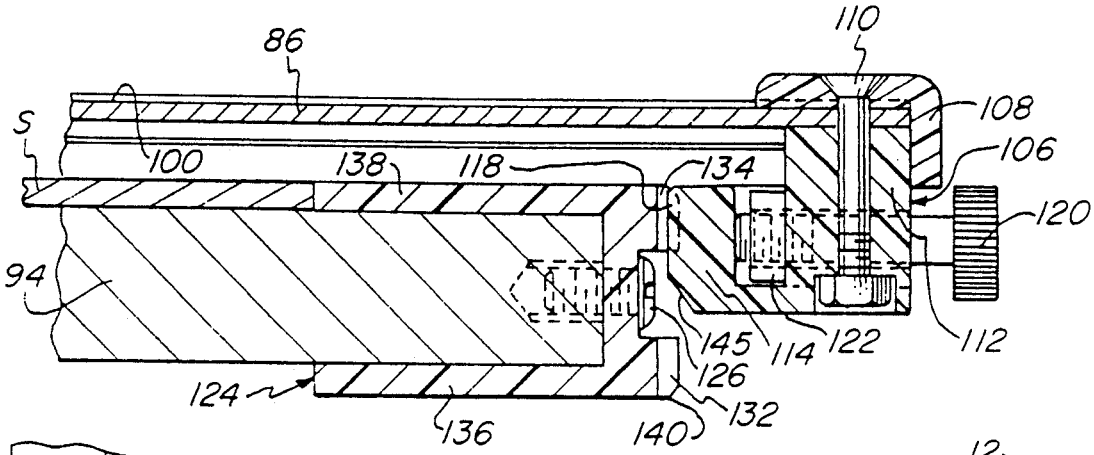
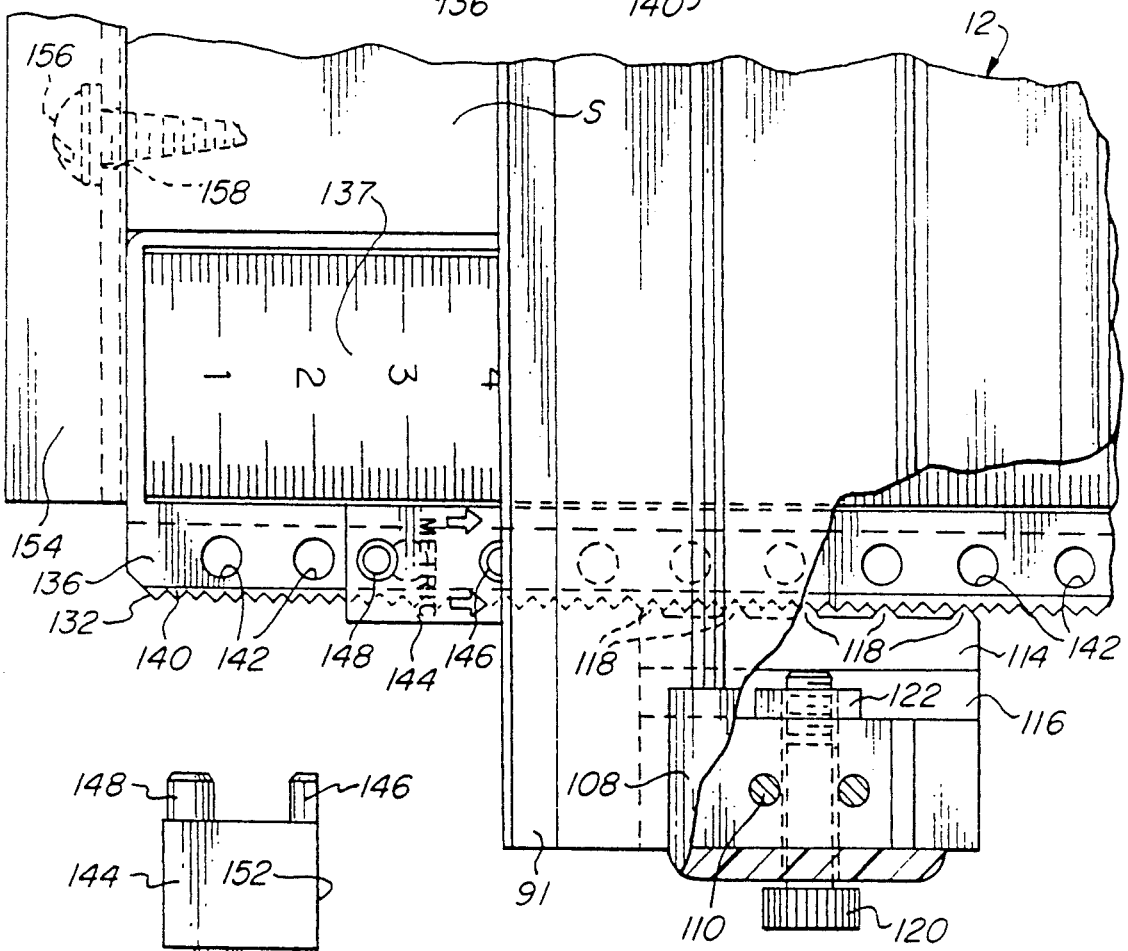
FIG. 14
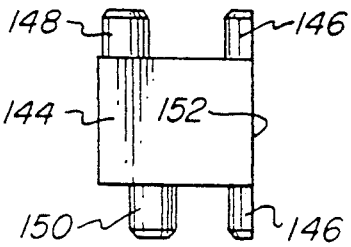
FIG. 15

BASE AND CLAMPING BAR ASSEMBLY

BACKGROUND OF THE INVENTION

Mat boards with cut sight openings are commonly used for framing photographs, pictures and the like. Numerous forms of manual devices and machines are disclosed in the art, and are commercially available in both professional and also "DIY" (do-it-yourself) models, for cutting both the outside periphery of such mats (normally done with a "straight" cut, at a perpendicular angle) as well as the sight opening (normally done with a "bevel" cut, at an acute angle).

Exemplary apparatus is shown in the following U.S. patents: Williams U.S. Pat. No. 1,250,538, issued Dec. 18, 1917, Umholtz U.S. Pat. No. 2,924,010, issued Feb. 9, 1960, Meshulam et al U.S. Pat. No. 4,064,626, issued Dec. 27, 1977, Pierce U.S. Pat. No. 4,262,419, issued Apr. 21, 1981, Beder U.S. Pat. No. 4,685,366, issued Aug. 11, 1987, and McGinnis U.S. Pat. No. 4,986,156, issued Jan. 22, 1991; a system generally more sophisticated than the foregoing is disclosed by Kozyrski et al in U.S. Pat. No. 4,798,112, issued Jan. 17, 1989. Davidson U.S. Pat. No. 4,831,739, issued May 23, 1989, provides an adjustable template device, for framing and cutting sheet material, in which resilient pins engage lines of detents so as to retard relative sliding movement of adjacent members.

A need exists for a support assembly suitable for use in association with such cutters, especially for effectively holding the sheet material workpiece against a supporting base, and for quickly, conveniently and precisely locating cutter guide means, such as an elevated track, at selected distances from a reference edge.

SUMMARY OF THE INVENTION

Accordingly, it is the broad object of the present invention to provide a novel support assembly that satisfies the foregoing needs. More specific objects are to provide an assembly in which a supporting base coacts with a spanning, elongate clamping member to securely and truly engage the latter in each of a multiplicity of positions at precise increments spaced along the opposite ends of the base; to provide such an assembly in which the base is of a double-sided character, to permit spacing of the clamping member at distances measured alternatively in both of two different systems (e.g., English and metric); and to provide such an assembly which is also facile to use, and of relatively incomplex design and construction.

It has now been found that the foregoing and related objects of the invention are attained by the provision of a support assembly comprising a workpiece-supporting base having opposite ends and a planar support surface therebetween; an array of numerous teeth extending along at least one of the ends of the base and accessible from the plane of the support surface, the array including at least one rectilinear section in which the teeth are substantially identical to, and equidistantly spaced from, one another; and an elongate clamping member spanning the base from end-to-end and having opposite end portions with engagement means thereon for engaging the ends of the base. The engagement means on at least one of the end portions comprises a part that is disposed in confronting relationship to the "one" section of the array of teeth, and that has a row of detent elements thereon aligned with the one section and configured and positioned to mesh with the teeth thereof, the detent elements being engageable from a position of the clamping member above the support surface. The row of detent elements is substantially shorter than the one section of teeth, and thus permits the clamping member to be affixed on the base, by interengagement of the detent elements and teeth, in a multiplicity of positions displaced from one another along the ends thereof.

Normally, the base will have edge structure extending along its "one" end and generally perpendicular to its support surface. The clamping member will generally comprise a clamping bar that spans the base and has a substantially flat bottom surface to which the confronting end part extends generally perpendicularly, disposing it in confronting relationship to the edge structure of the base. In most instances, the clamping bar will have an upper portion with guide means thereon, for slidably engaging a cutter member for movement therealong; the guide means will usually comprise an elevated, endwise extending central portion that is of effectively uniform cross section along its length, taken (i.e., viewed) in planes to which its longitudinal axis is normal.

Either all of the teeth or all of the detent elements will preferably be elongated in a direction generally normal to the support surface of the base and the bottom surface of the clamping bar, and most desirably both the teeth and also the detent elements will be of elongate form. The confronting part on the clamping bar will advantageously be adjustable in a direction substantially normal to the base edge structure, so as to enable variation of the level of force with which the detent elements engage the teeth.

The base will normally have a linear distance scale thereon, extending along its "one" end and on a surface that is substantially coplanar with its support surface. A locating device may also be provided, constructed to coact with the base and the clamping member to facilitate relative positioning thereof. For that purpose, the locating device and the base will have interengageable elements thereon, constructed to enable the locating device to be affixed at each of a multiplicity of positions along the end of the base; the affixing elements on the base will extend adjacent the distance scale provided, and the locating device will have a contact face for engaging the clamping member. The affixing elements on the base may, more specifically, comprise a row of equidistantly spaced apertures, and the locating device may comprise a body having a plurality of pin elements which project in one direction and provide the affixing elements, the pin elements being spaced and dimensioned for insertion into the base apertures.

The assembly of the invention will usually employ a base that has an array of teeth along both of its ends, used with a clamping member that has cooperatively constructed engagement means on both of its end portions. The base will most desirably have opposite side faces, the first-mentioned support surface being disposed on one face, a second planar support surface being disposed on the other, and the array of teeth being accessible from the plane of both support surfaces. Advantageously, the base will comprise a planar board and at least one attached rack member, the rack member providing one end of the base and the array of teeth extending therealong.

In the double-sided embodiments the array will preferably comprise two sections, each section including numerous substantially identical, equidistantly spaced teeth. One section of the array will be disposed more proximate the "first" support surface than it is to the "second," the other section being disposed in the converse relationship. The edge structure of the base will extend perpendicularly to both support surfaces, with the "first" and "second" sections of the array extending parallel to one another therealong. The spacing between the teeth of the first section will usually be different from that of the second section, normally being in English and metric systems intervals, respectively. A separate, appropriately located linear distance scale will generally be provided in each system of measurement, as will the locating device and the interengageable affixing elements. The detent elements of the clamping member engagement means will most desirably be equidistantly spaced from one another, with a center-to-center spacing of about 8 millimeters (0.31 inch) or a small multiple thereof (i.e., 16 or 24 millimeters), for alternative engagement with the teeth of both sections of the array. The teeth and the detent elements will desirably also be of pointed, or angular, cross section to best adapt them for the same purpose.

BRIEF DESCRIPTION OF THE DRAWINGS

FIG. 13 is a sectional view taken along line 13—13 of FIG. 11;

FIG. 14 is a view similar to FIG. 11, but showing the workpiece-supporting base inverted side-for-side;

FIG. 15 is an elevational view of the locating block utilized in the system illustrated;

DETAILED DESCRIPTION OF THE ILLUSTRATED EMBODIMENTS

Figure 5:
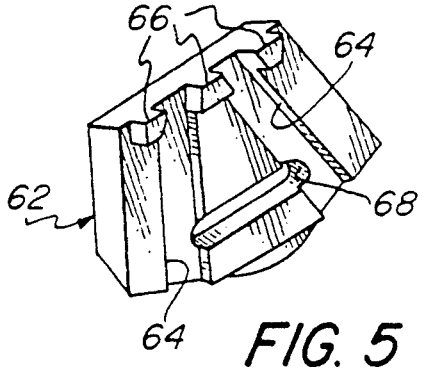
FIG. 5 is a perspective view showing the cover or clamping piece utilized in cooperation with the handle member of the cutting head.
Figure 6:
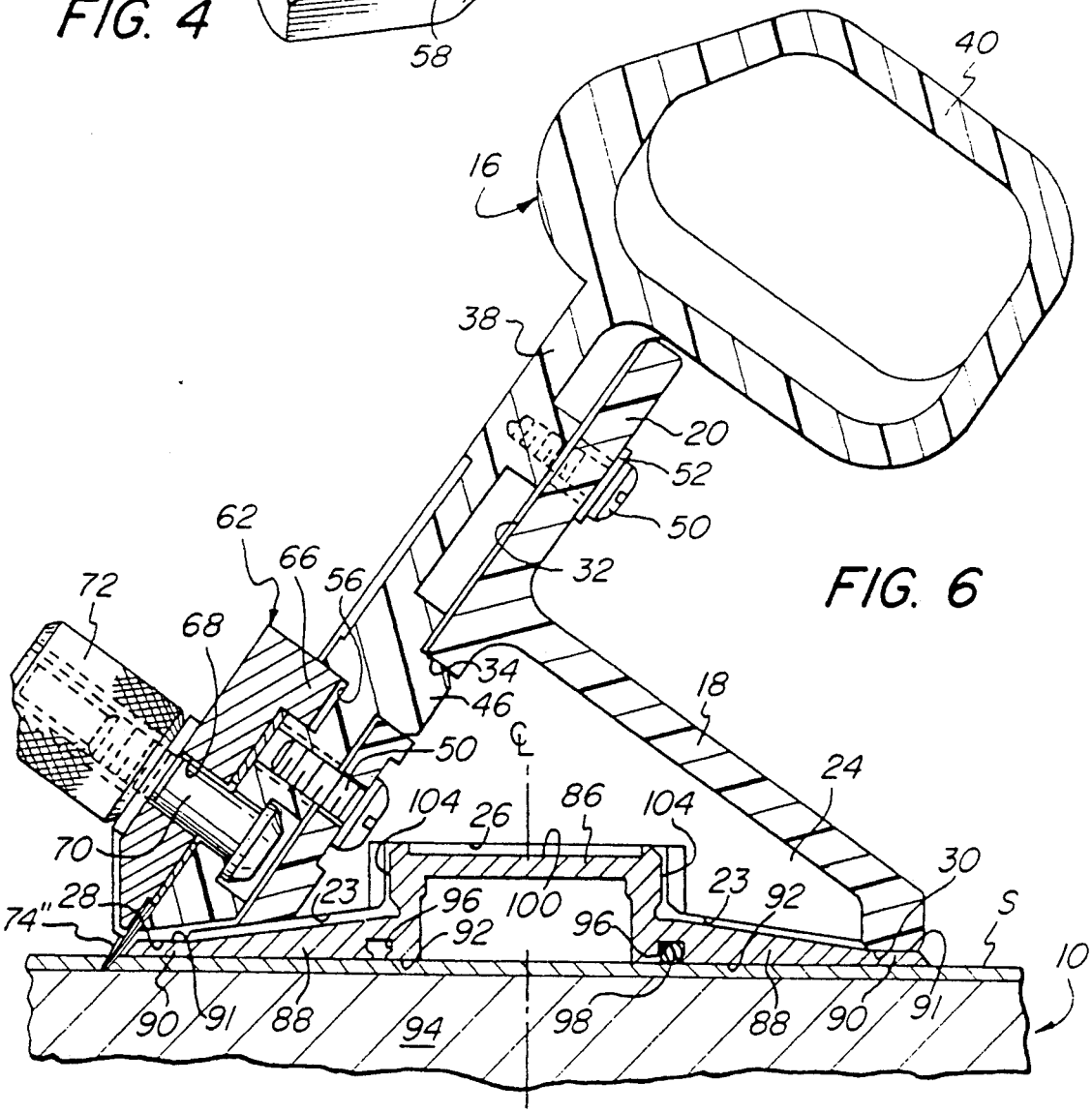
FIG. 6 is a gragmentary sectional view taken along line 6—6 of FIG. 1 and drawn to an enlarged scale.

Turning initially to FIGS. 1 through 10 of the drawings, therein illustrated is a system for cutting sheet material "S", and including a workpiece-supporting base assembly generally designated by the numeral 10, a clamping bar assembly generally designated by the numeral 12, and a cutter including a base and a head assembly, generally designated respectively by the numerals 14 and 16. The cutter base 14 comprises a hollow elongate body 18, of generally triangular cross section, including opposite end walls 22 and internal walls 24 (only one of each of which is visible), the walls 22, 24 being upwardly indented by a rectangular notch 26 so as to effectively define along the length of the body 18 a downwardly opening channel of effectively uniform, rectangular cross section. The lower edges 23 of walls 22, 24 decline from adjacent the indentations 26 in both directions toward the opposite outer margins, at which are formed underlying bearing surfaces 28 and 30 extending longitudinally therealong. It will be noted that the lower portion of the body 18 is substantially symmetric to the opposite sides of a vertical plane (in the normal operating position of the cutter) extending through the center of the channel (i.e., it is symmetric in planes to which the axis of the channel is normal), as best seen in FIG. 6.

The upstanding wall 20 on the base 18 has a flat forward contact surface 32, through which extends a central aperture 34; arcuate slots 36, 36' are formed about the aperture 34, and threaded holes 37 extend therethrough for threadably engaging set screws 39. The set screws bear upon tabs (not visible) formed within the base, which in turn bear upon the supporting track for varying the pressure applied thereagainst. A pair of threaded apertures 41 extend downwardly through the shoulders formed on the body 18, adjacent the opposite ends of the upstanding wall 20, for a purpose that will be discussed more fully below.

The head assembly 16 includes a flat and relatively wide supporting arm 38, which has a bulbous handle portion 40 on its upper end and a V-shaped edge 42, with a beveled marginal portion 44, defining its lower boundary. A cylindrical stub 46 extends rearwardly from the arm 38, and four threaded holes 48 are formed thereinto in an arcuate array, centered with reference to the stub 46.

As can be seen in FIG. 6, the head assembly 16 is pivotably mounted on the base 14 by engagement of the stub 46 in the central aperture 34 of the upstanding wall 20; the parts are secured by three screws 50, which pass through washers 52 and thereafter through the slots 36, 36' and into the threaded holes 48, 48'. It will be appreciated only two of the holes 48 (normally, the outermost ones) will receive screws 50, the others being employed to limit the degree of pivotable movement of the head, if so desired. The front face of the supporting arm 38 is formed with two upwardly convergent rectilinear channels 54, a laterally extending elongate cavity 56, a slot 58 therebelow, and a shallow trapezoidal recess 60 thereabove.

Figure 7:
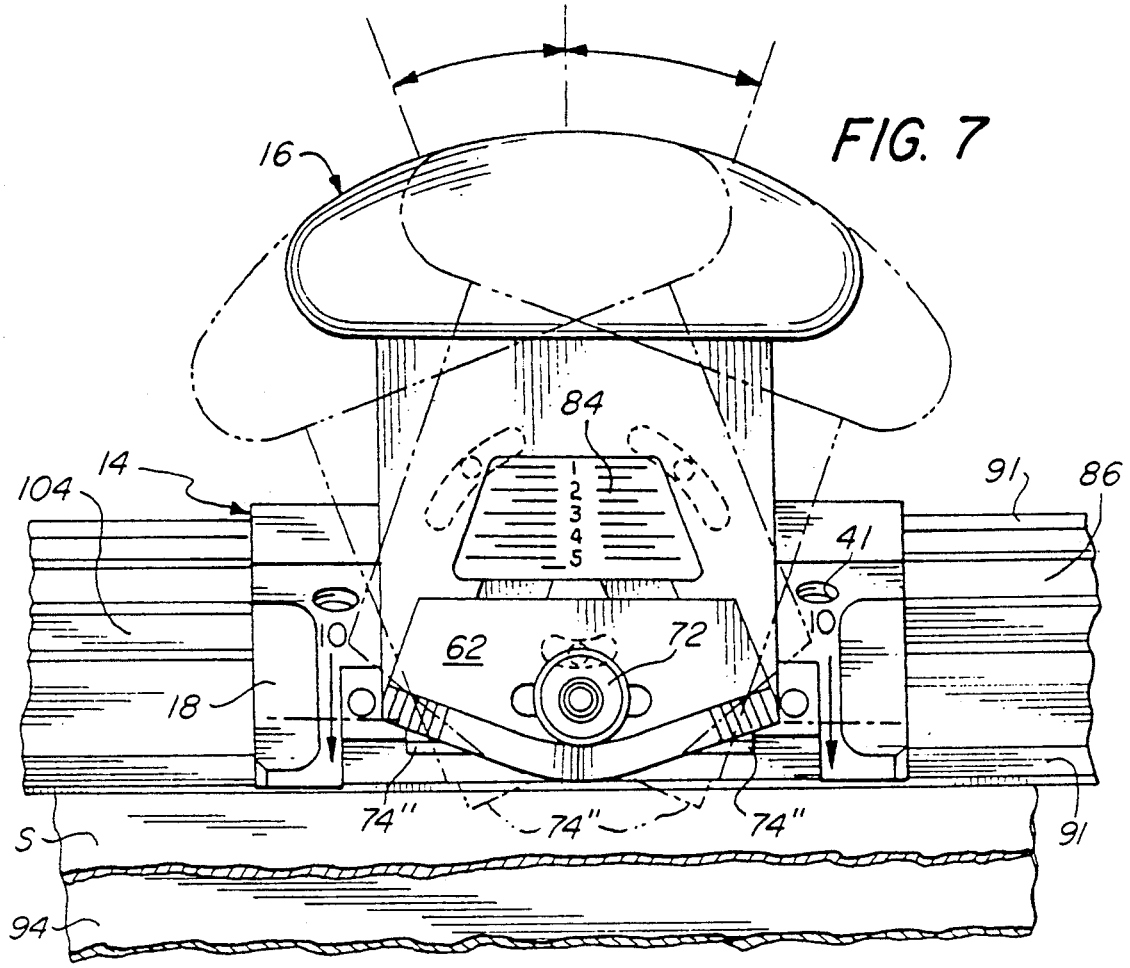
FIG. 7 is a fragmentary front elevational view of the system of FIG. 1, showing (in full line) the cutting head in its null position, and showing (in phantom line) the head pivoted for operation in both opposite directions from the null position.

The cutter assembly also includes a clamping piece, generally designated by the numeral 62. The rearward or innermost face of the clamping piece is, as shown in FIG. 5, formed with upwardly convergent channels 64, and an elongate, laterally extending slot 68; with the clamping piece 62 and arm 38 in assembly, as illustrated, the channels 54, 64 cooperate with one another to define open-ended passages. A stud 70, having an enlarged, straight-sided oval head, extends through the aligned slots 58, 68 and the aperture 76 of the rectangular blade 74, and engages the knurled nut 72 to secure the blade on the lower end of the handle assembly. The upper edge 74' of the blade bears upon the undersides of three teeth 66 to maintain blade position; the teeth 66 project from the clamping piece 62, and seat in the cavity 56 of the arm 38. Like the supporting arm 38, the clamping piece 62 has a V-shaped lower edge 77 with a beveled marginal portion 78, thus cooperating with the lower portion of the supporting arm to permit the corner portions 74" of the blade 74 to protrude beyond the lower boundaries of the head assembly for cutting without obstruction; this is best seen in FIG. 7. The aligned slots 58, 68 permit limited shifting of the blade 74 across the head, and thereby enable ready variation of the depth of cutting.

Figures 1, 2:
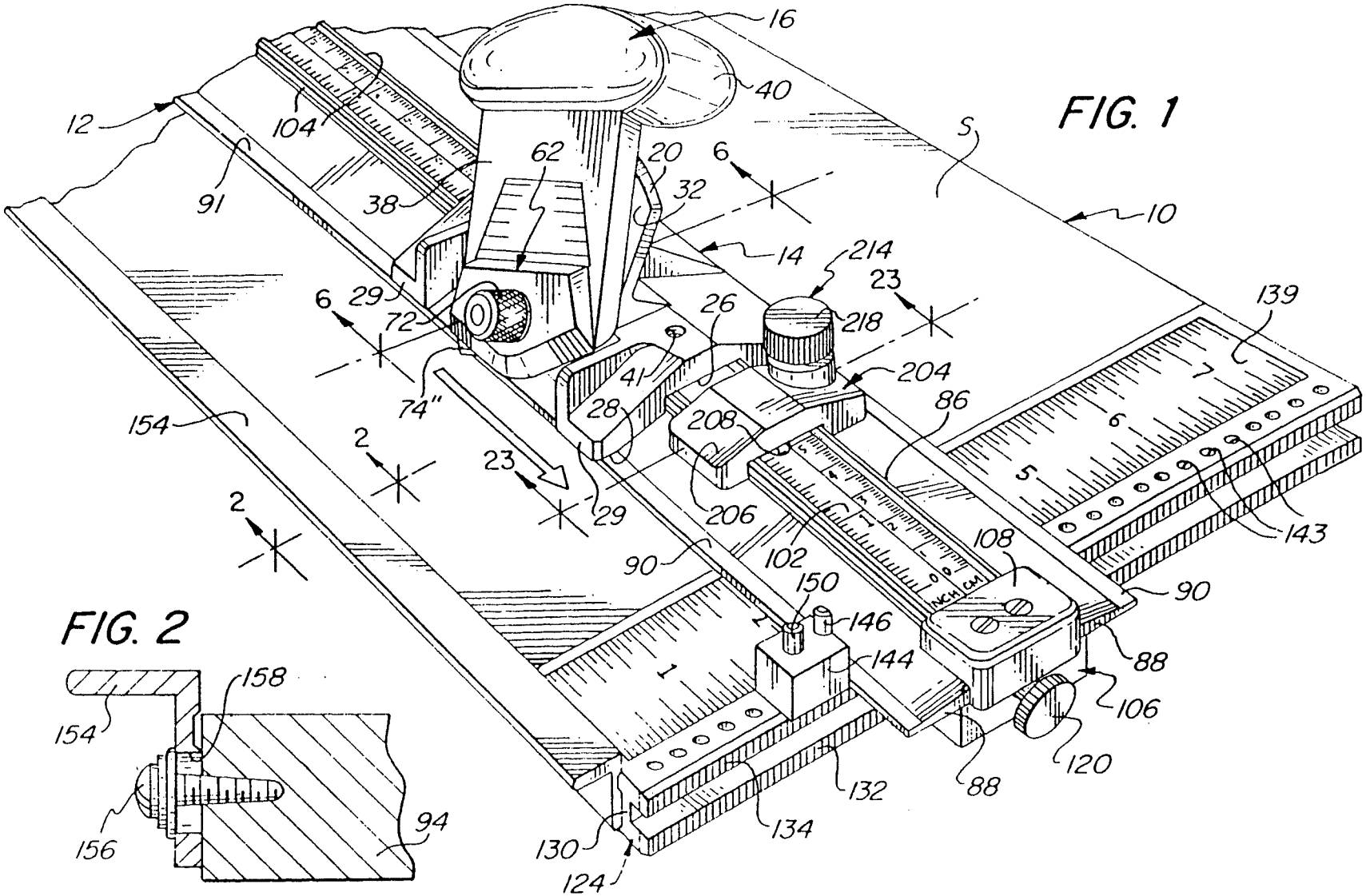
FIG. 1 is a fragmentary perspective view showing a system embodying the present invention.
FIG. 2 is a fragmentary sectional view taken along line 2—2 of FIG. 1 and drawn to a scale enlarged therefrom.
Figure 3:
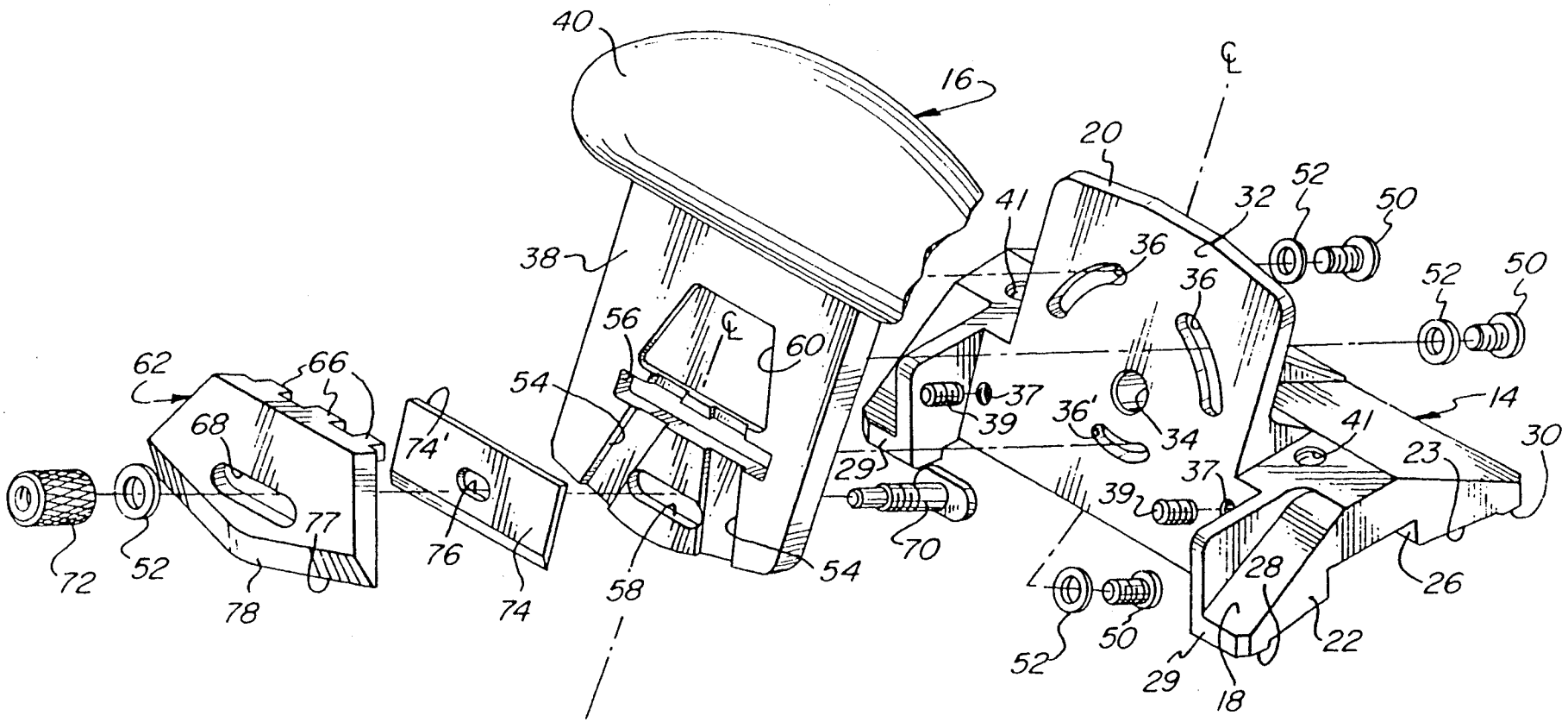
FIG. 3 is an exploded perspective view of a cutter provided hereby.
Figure 4:
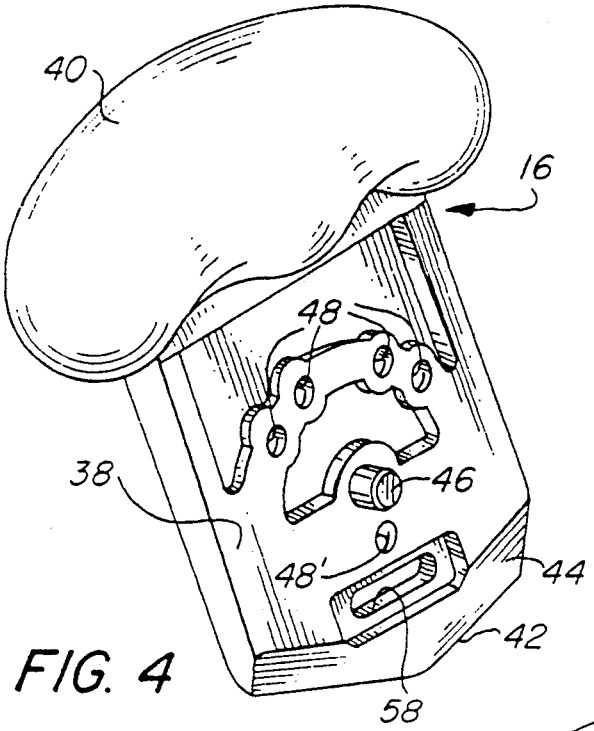
FIG. 4 is a perspective view showing the handle member comprising a component of the cutting head utilized in the cutter of FIGS. 1 and 3.

With the head pivoted counterclockwise, as shown in FIG. 1, cutting of the workpiece S would occur with the cutter moving in the direction indicated by the arrow. Needless to say, the head would be pivoted clockwise to cut in the opposite direction. In both cases the operative blade portion 74" penetrates the underlying sheet material S in a plunging action.

Figure 8:
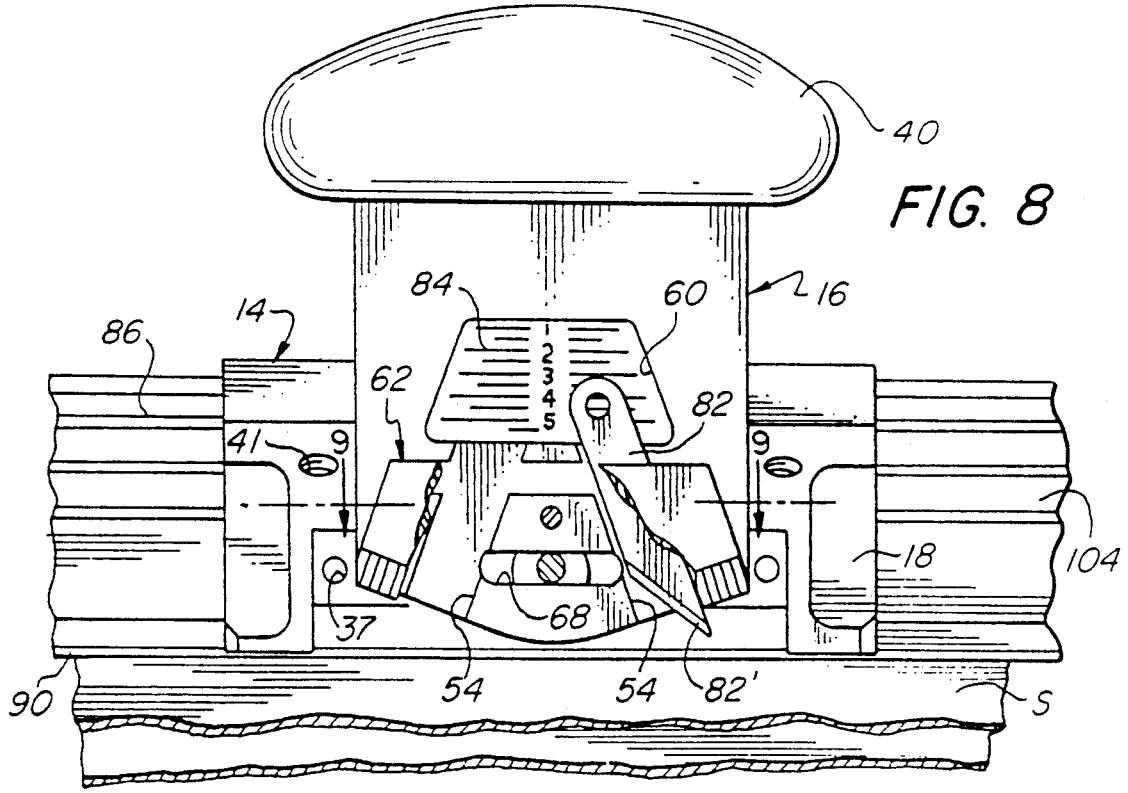
FIG. 8 is a view similar to FIG. 7, in which is utilized a second form of blade and in which a section of the clamping piece is broken away to show underlying features.

FIG. 8 shows the cutter used with a second form of blade 82, which is fabricated from an elongate piece of flat metal, sharpened as at 82' (a so-called "Dexter #3" blade). The blade 82 is secured within one of the passages formed by the cooperating channels 54, 64, and is so positioned that the point of its sharpened edge 82' protrudes slightly beyond the lower boundary of the head. As will be self evident, the blade 82 is brought into operative position by pivoting the handle member in a clockwise direction (as the cutter is depicted in FIG. 8), again causing the point of the blade to penetrate the workpiece in a plunging manner. To cut in the opposite direction, a blade 82 would of course be secured in the other passage, in mirror-image relationship.

FIG. 8 (among others) also shows a depth-indicating scale insert 84 affixed within the shallow recess 60, as may be provided by a pressure-sensitive adhesive-coated label; alternatively, appropriate scale markings may be of molded fabrication. Alignment of the curved upper end of the blade 82 with a selected graduation mark will enable a desired depth of cut to be readily replicated.

Figure 9:
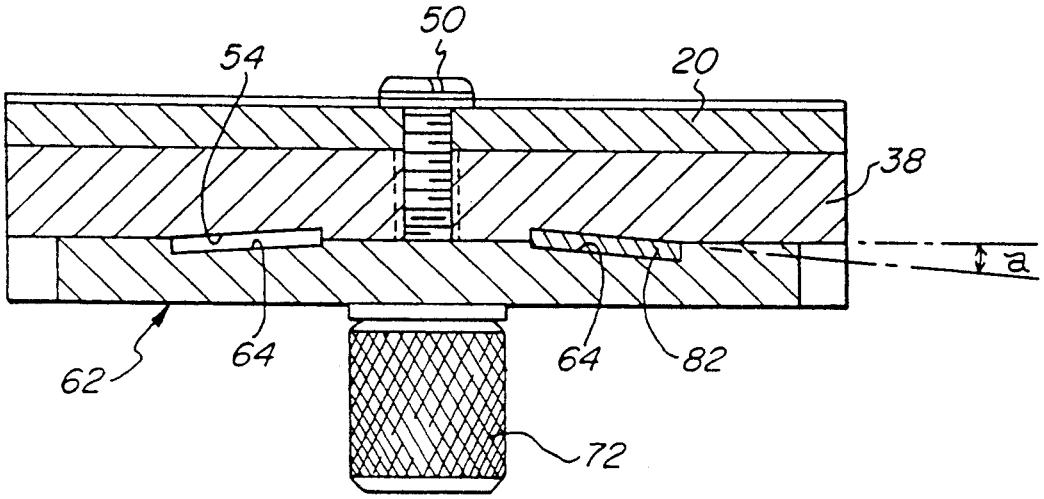
FIG. 9 is a sectional view taken along line 9—9 of FIG. 8 and drawn to an enlarged scale.

As seen in FIG. 9, the blade 82 is secured by the cutting head at a slight angle "a" to the travel path axis. The angle will normally have a value of 1° to 2°, as is known to be desirable from the standpoint of counteracting the tendency that the blade would otherwise have to wander from the intended cut line, and thereby to produce less than ideal precision.

Figure 10:
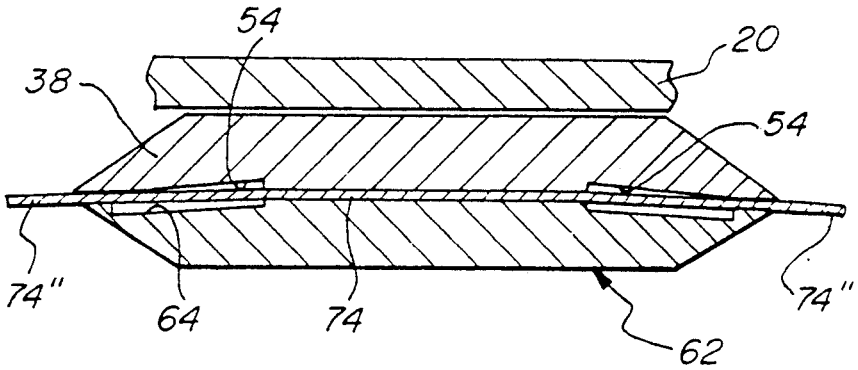
FIG. 10 is a sectional view taken along line 10—10 of FIG. 7 and drawn to an enlarged scale.
Figure 11:
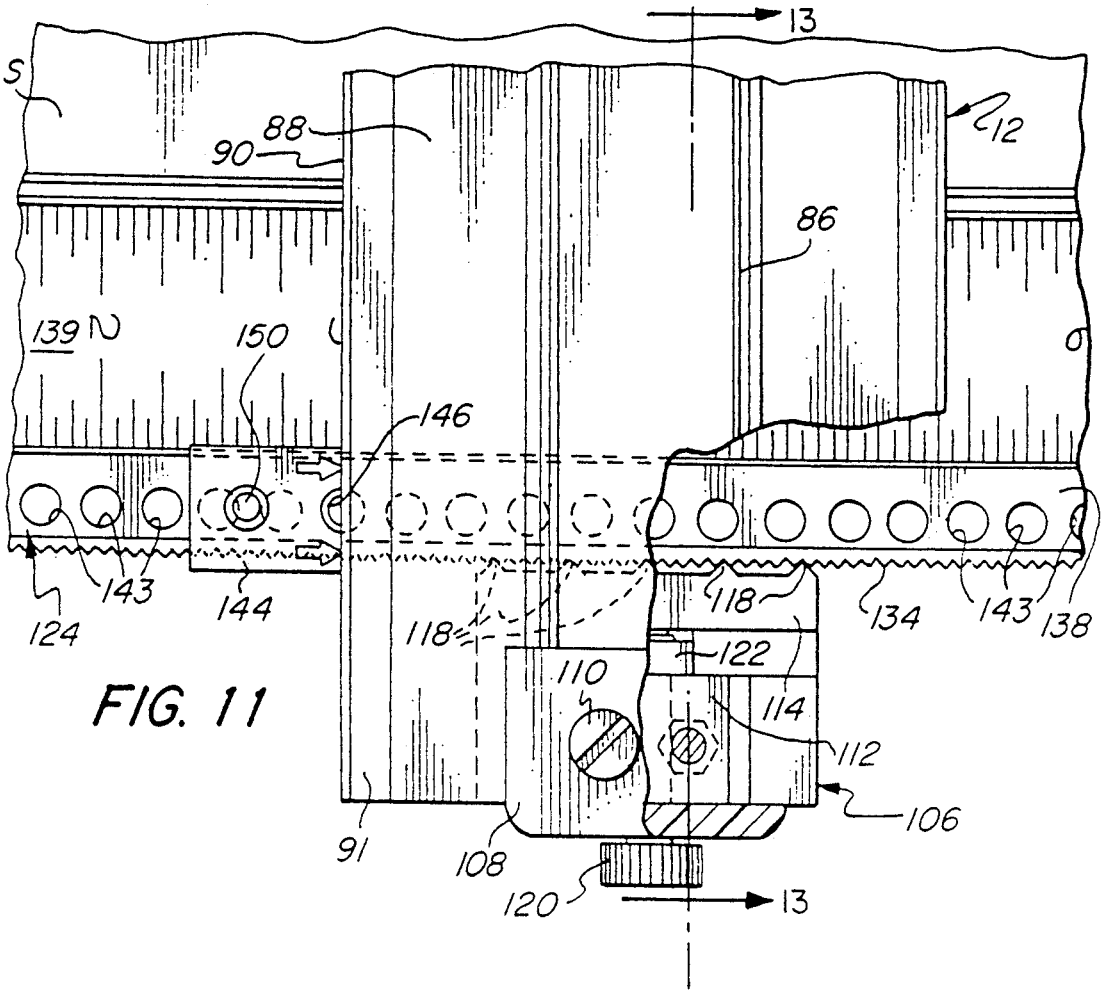
FIG. 11 is a fragmentary plan view of a right end section of the system, as depicted in FIG. 1, inclusive of the workpiece clamping means employed.
Figure 12:
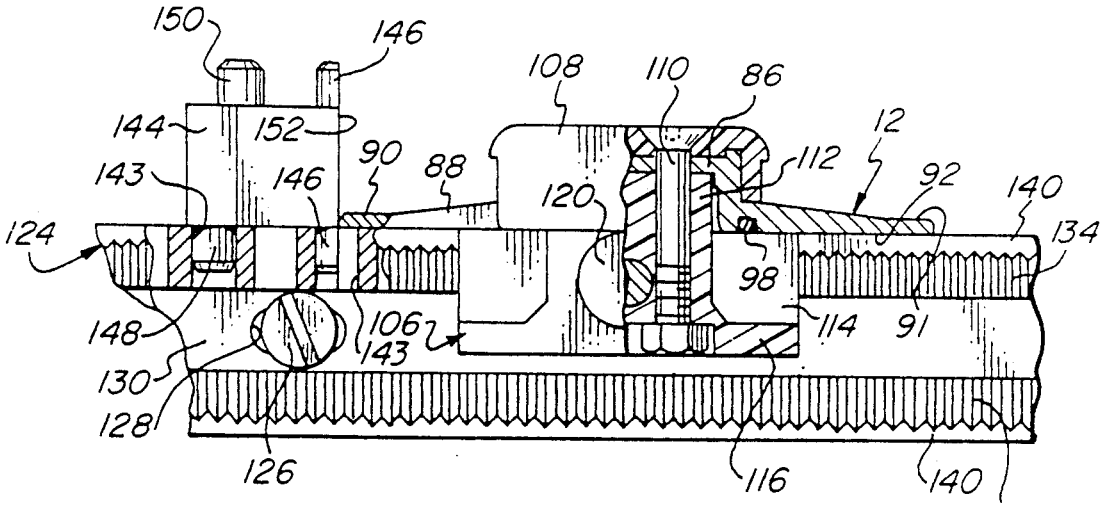
FIG. 12 is a fragmentary elevational view of the section of the system shown in FIG. 11.

The feature depicted in FIG. 10 achieves essentially the same purpose in those instances in which a rectangular blade 74, or another, comparably shaped (e.g., trapezoidal) blade, is employed. Thus, the outwardly directed face 78 of the arm 38 and the inwardly directed face of the clamping piece 62 are concavely and convexly contoured, respectively, to the same, large-radius value. Clamping of the blade 74 between the cooperating components will therefore cause its protruding corner portions 74" to be angled slightly (i.e., typically at 1° to 2° ) with reference to the line of cutting, effective in both direction as well as inversions of the head. Such deformation will also produce a desirable stiffening of the blade 74.

The cutting head illustrated is designed for use with a workpiece clamping member, such as the assembly 12 hereinabove referred to with reference to FIG. 1. Since that Figure only fragmentarily shows the system, it should be pointed out that the opposite ends of the workpiece-supporting base 10, as well as of the clamping bar assembly 12, will be of substantially identical construction and will have the features hereinafter described with respect to only one end.

The clamping bar assembly 12 consists of an elongate extrusion (normally of aluminum) which is, as best seen in Figure 6, symmetrical about a longitudinal plane through the center line, the plane being vertical in the position of normal use. The extrusion is formed with an elevated track or central portion 86 of generally rectangular cross section, below and from the opposite sides of which extend outwardly tapering shoulder portions 88, terminating in flat marginal portions 90 which provide running surfaces 91 upon which ride the bearing surfaces 28 and 30 of the base 14 when the cutter is assembled therewith. The profile of the upper portion of the extrusion conforms in male/female relationship to that of the bottom portion of the cutter base 14, thus permitting slidable seating of the cutter on the clamping bar; the symmetry of the mating parts, about a vertical plane through the channel and track, enables end-for-end inversion of the cutter for ambidextrous use.

The underlying surfaces of the shoulders 88 are flat and coplanar, being thus adapted for holding the sheet material S flat against the top surface of the board 94 of which the work-piece-supporting base assembly 10 is comprised. A shallow slot 96 extends along the inner margin on the underside of each flange 88, in one of which is shown a rubber element 98 for better restraint of the sheet S against shifting under the clamping bar; elements 98 seated in both slots 96 will generally afford optimal balance. Formed into the top surface of the elevated portion 86 of the bar is a shallow recess 100, in which is received a scale-bearing insert 102; as seen in FIG. 1, the insert 102 includes both metric and English system linear distance scales. The elevated portion 86 also provides rectilinear lateral surfaces 104 along its entire length, below which extend undercut grooves 222.

FIGS. 11 through 15 show features of the clamping bar assembly in greater detail. In particular, an engagement sub-assembly is provided at both of the opposite ends of the bar (only one of which is illustrated), which consists of a gripping block, generally designated by the numeral 106, and a cap piece 108 secured in assembly therewith by two nut and bolt fasteners 110.

The gripping block 106 consists of a body portion 112 and a tab portion 114, the latter having a chamfered lower longitudinal edge 145 and being flexibly joined to the body portion by a relatively thin connecting element 116. A row of five detent elements or pointed teeth 118 extend at equidistantly spaced locations along the inner face of the tab 114 in a normally vertical orientation, perpendicular to the axis of flexure; the detents 118 are spaced with a center-to-center distance of 0.314 inch (7.98 millimeters). An adjusting screw 120 passes laterally through the body portion 112, and has its threaded inner end portion engaged in a square nut 122 which is trapped against rotation between elements of the gripping block. The tip of the screw 120 bears against the outer face of the tab 114 for application of a variable level of force thereto, and to eliminate excess clearance.

Both opposite end margins of the base board 94 (only one of which is, once again, illustrated) are covered by elongate, U-shaped racks or channel pieces, generally designed by the numeral 124. They are held in place by screws 126 that extend through slots 128 in the central web portion 130 of the channel piece 124, which are longitudinally elongated to afford lateral adjustment. Parallel arrays numerous pointed teeth 132, 134 extend lengthwise on the channel piece 124 along the opposite margins of the web portion 130, the individual teeth being oriented perpendicularly to the longitudinal axis; in the array 132, the teeth are graduated in metric increments, with a pitch of 2 millimeters, whereas they are graduated in English system increments in the array 134, with a pitch of 0.0625 inch (1.59 millimeters).

Flanges 136, 138 extend inwardly from the web portion 130 over the opposite faces of the board 94. They carry on their external surfaces distance scales 137, 139, corresponding to the associated arrays of teeth 132, 134 in respect of the system of linear distance measurement indicated. Lines of equidistantly spaced holes 142, 143 extend along the flange portions 136, 138, and are once again located to correspond to the increments of the adjacently disposed (and functionally associated) scales, 137 and 139, respectively.

FIG. 15 best illustrates the locating block that is employed, in conjunction with the edge channel piece 124 on the ends of the base 94, to facilitate positioning of the clamping bar assembly. The block consists of a generally rectangular body 144, having a flat forward face 152 on one side. Semi-circular pins 146 extend in opposite directions from the ends of the body, with their diametric, flat surfaces contiguous with the face 152. A circular pin 148 extends in the same direction and in alignment behind the semi-circular pin 146 on one end of the block, and a like, circular pin 150 extends similarly from the opposite end; the pin 148 is spaced further from its associated semi-circular pin 146 than is the pin 150. It will be appreciated that these spacings correspond to the spacings between the metric system/English holes 142, 143 in the opposite sides of the channel piece 124, and enable the locating block to be engaged alternatively therewith.

The flat surface 152 of the locating block serves to engage the edge of one of the shoulder portions 88 of the clamping bar assembly 12, and thereby to readily position it at a selected distance from the front edge of the board 94, simply by alignment of the face 152 of the block with the appropriate marking on the applicable scale 137 or 139. The clamping bar assembly 12 is in turn engaged on the support base 10 by urging it downwardly thereupon with the edge of the clamping bar abutted against the locating blocks at the opposite ends of the board, causing the detents 118 on the tab 114 of the gripping block 106 to mesh with the teeth of the upwardly directed array, 132 or 134. It will be appreciated that the chamfer 145, and the bevel edges 140 extending along the arrays of teeth, cooperate to facilitate such engagement. It will also be appreciated that the detents 118 on the tab 114 are spaced so as to permit meshing irrespective of whether the metric or the English system array, 132 or 134, is involved, and that the level of gripping force can readily be adjusted by tightening or loosening of the screw 120. Although not illustrated, it might be noted that springs or other means can be provided and so located as to exert a constant upward bias upon the clamping bar assembly, thereby facilitating its release from the supporting base when downward force is relieved.

An L-shaped extrusion 154 is attached as a mat guide to the front edge of the board 94 by screws 156 received in vertical slots 158. This arrangement permits shifting of the extrusion 154 across the thickness of the board 94, to lower the abutment edge presented and thereby facilitate extension of the sheet material S thereover, for convenient downsizing.

Figure 16:
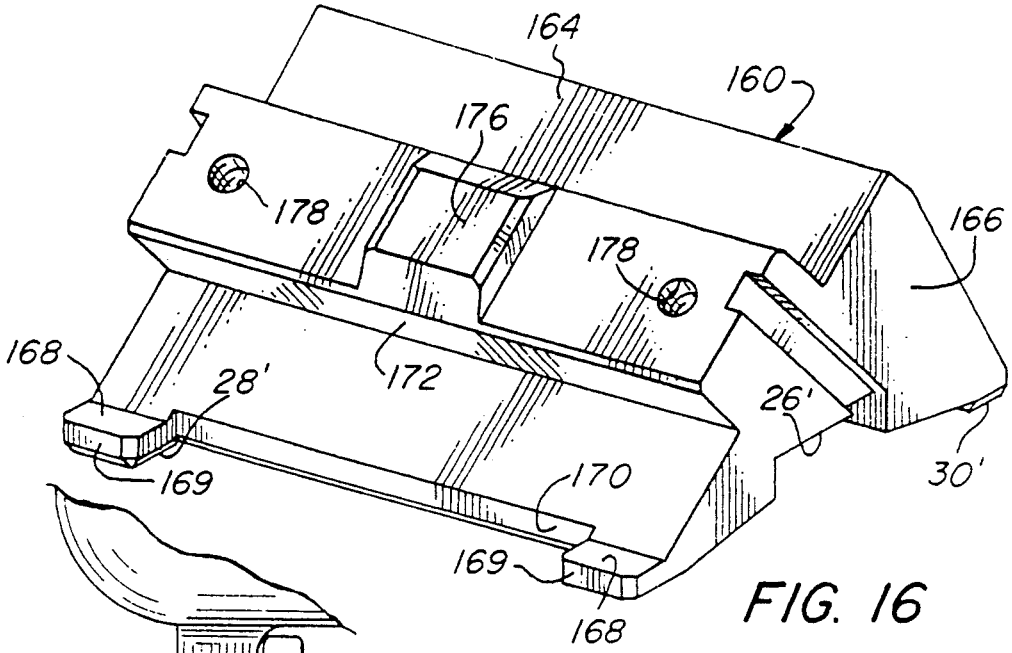
FIG. 16 is a perspective view of a supplemental wedge base constructed for utilization in assembly with the cutter shown in the preceding Figures.
Figure 17:
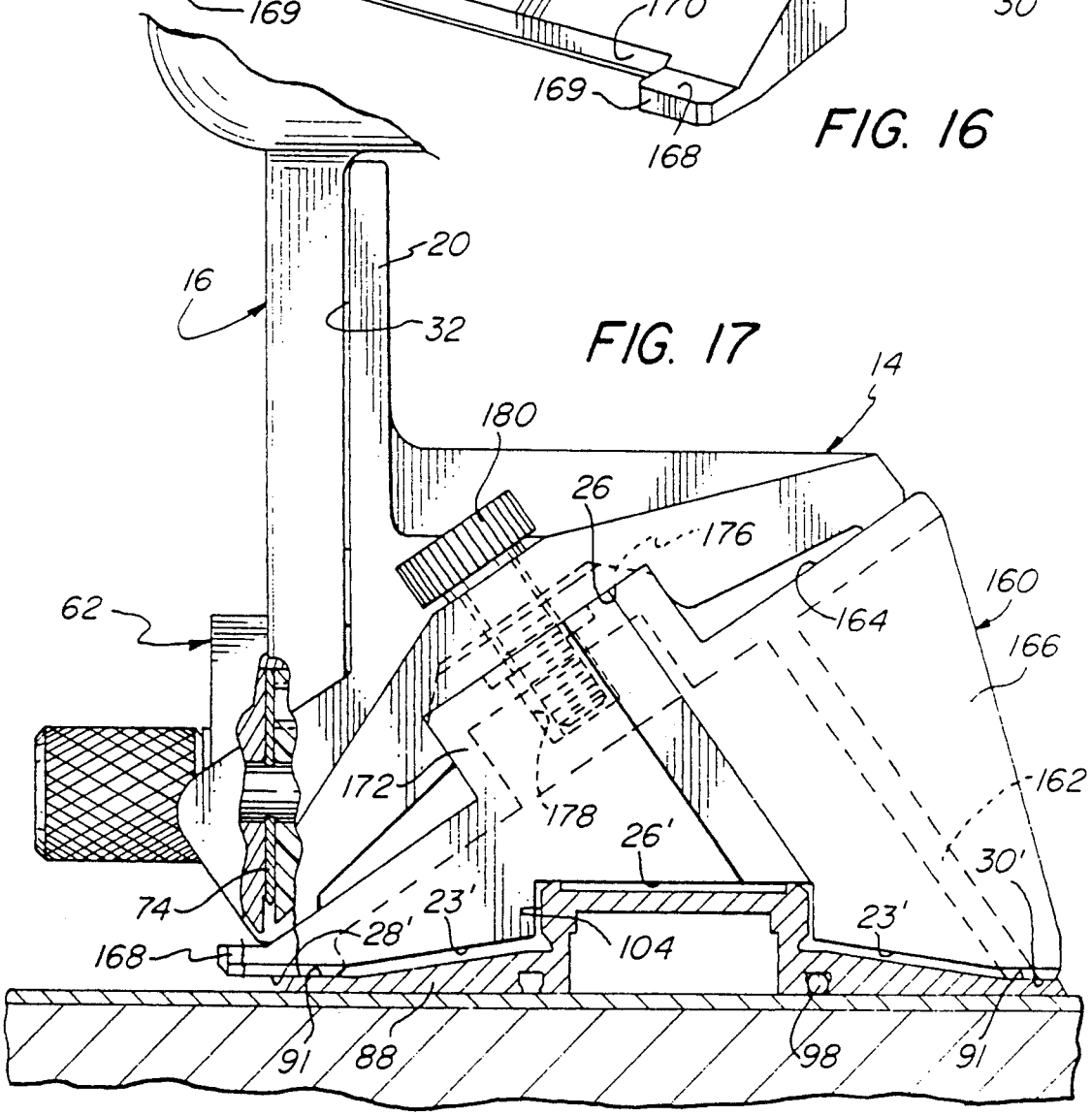
FIG. 17 is a fragmentary elevational view of the system, in partial section and with portions broken away to expose internal features, showing the cutter and supplemental wedge base in assembly and slidably engaged upon the clamping bar of the system.
Figure 18:
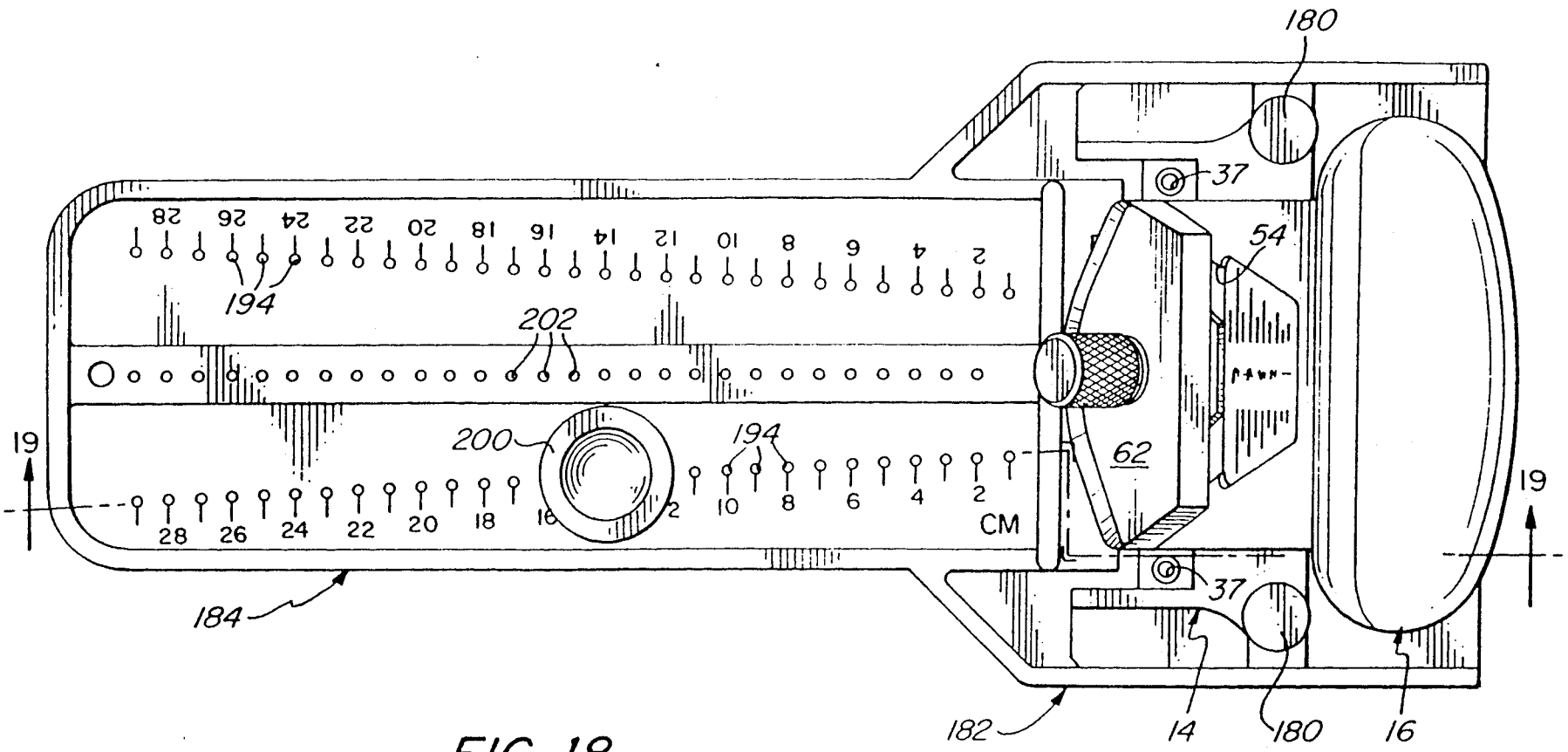
FIG. 18 is a plan view of the cutter assembled with a guide template.
Figure 21:
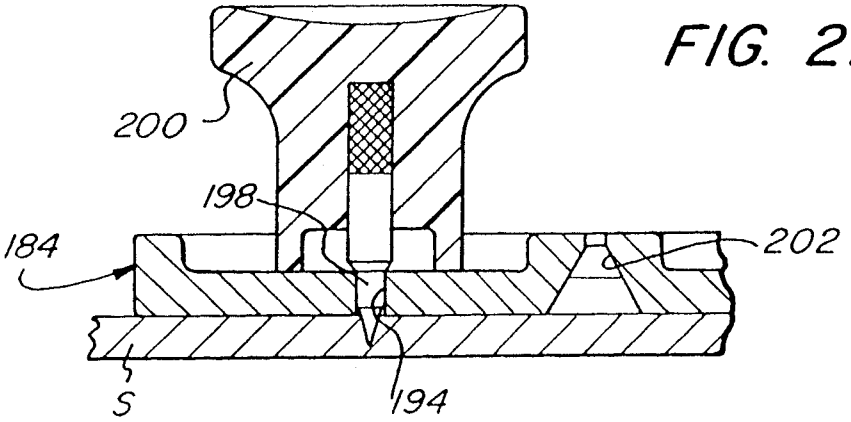
FIG. 21 is a fragmentary sectional view taken along line 21—21 of FIG. 20, drawn to an enlarged scale.
Figure 19:
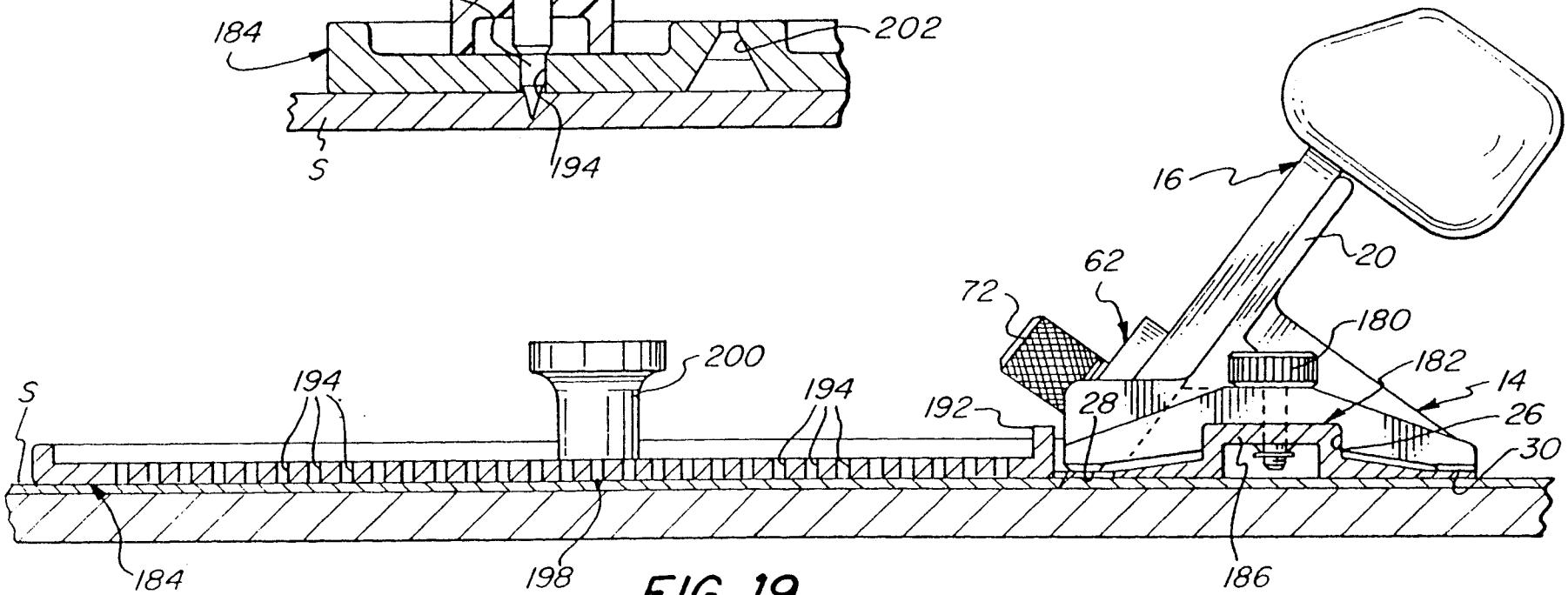
FIG. 19 is a fragmentary sectional view taken along line 19—19 of FIG. 18, showing the assembly illustrated therein disposed upon a supported piece of sheet material.
Figure 20:
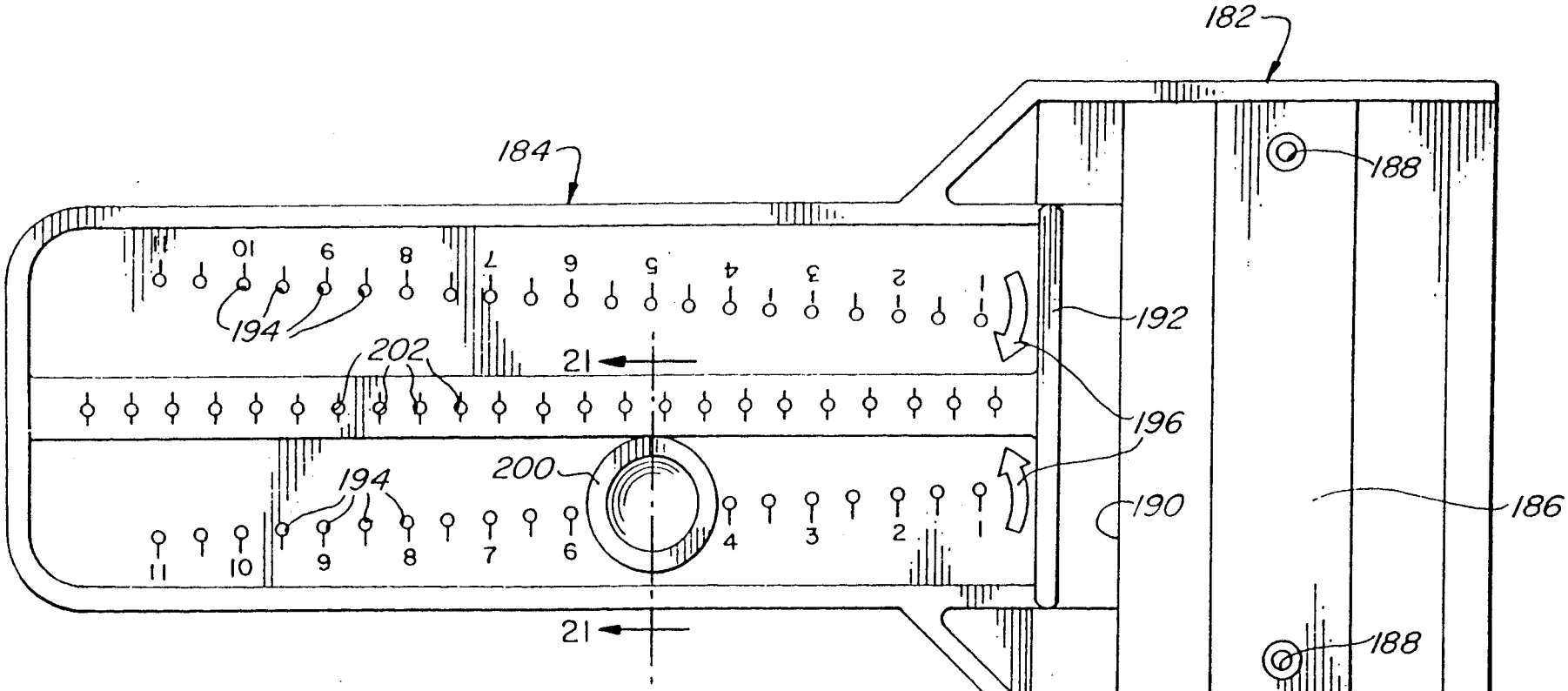
FIG. 20 is a plan view of the template of FIGS. 18 and 19, with the cutter removed.

With particular reference now to FIGS. 16 and 17 of the drawings, therein illustrated is a unit by which the cutter can be converted for making cuts normal to the sheet material S, rather than at an angle thereto as hereinabove described. The unit comprises a supplemental wedge base, generally designated by the numeral 160, which is hollow construction and consists of a back wall 162, a front wall 164, and opposite end walls 166 (only one of which is shown). The front wall 164 terminates at its lower edge in a pair of forwardly projecting feet 168, which define an indentation 170 to accommodate lower portions of the cutting head; the front of the feet provide bearing surfaces 169 for using the cutter by running it along any straight edge, as do the surfaces 29 on the cutter itself. The wedge unit has a bottom profile that is substantially the same as that of base 14 of the cutter; common numbers are therefore employed to designate the indentation, the bearing surfaces, and the declining edges that extend therebetween, differentiated by the addition of prime marks. By virtue of having such a bottom portion, it will be seen that the supplemental base unit 160 is adapted to slidably seat the track portion 86 and engage the clamping bar assembly in the manner hereinabove described with respect to the cutter itself.

The outer face of the top wall 164 is generally planar, and is oriented at an acute angle to the common plane in which the bearing surfaces 28', 30' are disposed. An elevated central portion 172 extends longitudinally across the face of the top wall 164, and has a profile that substantially duplicates that of the upper portion of the clamping bar assembly. It is thus similarly mated to the bottom portion of the cutter base 14 for secure seating within the indentation 26, with the bearing surfaces 28, 30 resting upon the face of the wall 164. In addition, however, the elevated portion 172 has an upstanding boss 176 formed centrally thereon, which is adapted to seat between the internal walls 24 of the cutter base 14; although not illustrated, it will be understood that the spacing between the internal walls 24 is substantially the same as the longitudinal dimension of the boss 176, so as to produce engagement therebetween against lengthwise displacement. Threaded holes 178 are provided in the shoulders of the elevated portion 172, to the opposite ends of the boss 176, and are so spaced as to align with the threaded apertures 41 of the cutter base 14 when it is mounted upon the supplemental base unit 160, thereby enabling the receipt of fasteners 180 for securely affixing the parts in assembly with one another.

As will be evident from FIG. 17, the angle at which the wall 164 of the base unit 160 is slanted, with reference to the plane of the bearing surfaces 28', 30' (generally 30° to 45°, and typically 35°), is geometrically complementary to the angle at which the front face 32 of the wall portion 20 is oriented with reference to the plane in which are disposed the bearing surfaces 28, 30 of the cutter base 14 (generally 45° to 60°, and typically 55°). Consequently, when the cutter is assembled on the base unit, the blade 74 (which is held parallel to the wall portion face 32) will be disposed at an angle of 90° to the plane of the sheet material S.

FIGS. 18 through 22 show a template, or guide piece, which is suitable for use alone, for marking borders, as well as for cutting circles in combination with the cutter described. The template has head and tail portions, generally designated respectively by the numerals 182 and 184. The head portion 182 is formed with elevated structure 186 profiled to mate with the bottom portion of the cutter base 14, and has a pair of threaded apertures 188 for engagement of the fasteners 180; it is thus adapted to mount the cutter, with or without the supplemental unit 160, and an elongate slot 190 is formed adjacent the tail portion 184 to permit passage of the blade.

A low ledge 192 extends along the slot 190 at the innermost end of the tail portion 184, and projects in the same direction as the structure 186; two divergent lines of equidistantly spaced numbered holes 194 proceed therefrom. Depending upon which of the blade elements is brought into operative position, for cutting in the direction indicated by the curved arrow representation 196 associated with each line of holes 194, the corresponding numerical value will represent a radial distance. To produce a circular cut, therefore, the tip 198 of the pivot piece 200 is simply inserted through one of the holes 194 to penetrate the surface of the workpiece S (normally into an underlayment), providing a fixed point about which the cutter can pivot for circumscribing a circle. The lines of holes 194 are angled to increase (typically to 4.50°) the 1° to 2° canting of the blades, as is desirable for making precise curved cuts.

Figure 22:
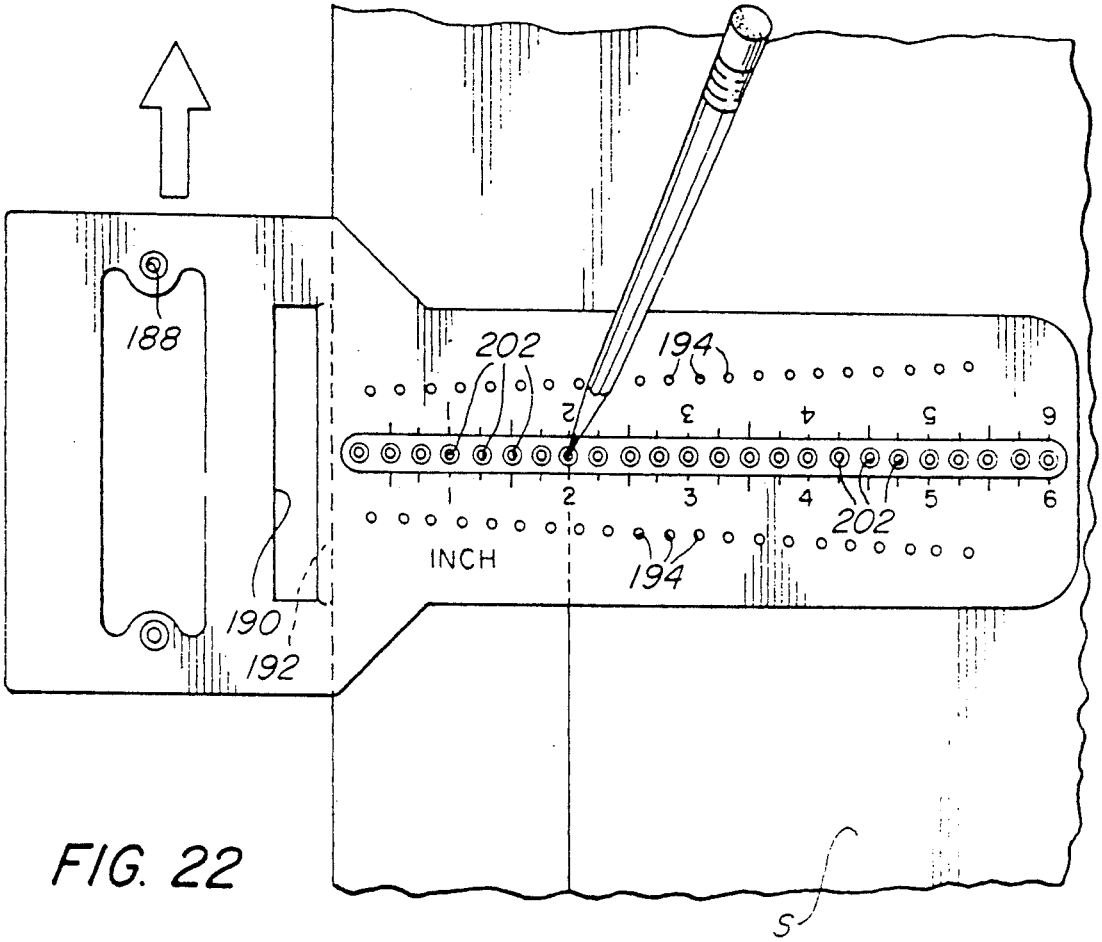
FIG. 22 is a plan view of the template inverted side-for-side and used for marking a border on a workpiece, which is fragmentarily illustrated.

FIG. 22 shows the template in use for marking a border along the edge of the workpiece. This is done with the template inverted, side-for-side, from the position shown in the preceding Figures, enabling sliding engagement of the low ledge element 192 against the edge of the sheet S. Marking is accomplished simply by inserting the point of a pencil (or pen, for decorating purposes) through one of the holes 202, which are formed at measured distances along the center line of the tail portion 184, and then running the template along the edge of the sheet, as guided by the ledge element 192. It will be noted from FIG. 21 that the holes 202 are downwardly tapered (in the orientation of use, inverted from that of FIG. 21) so as to best accommodate the pencil point.

Figure 23:
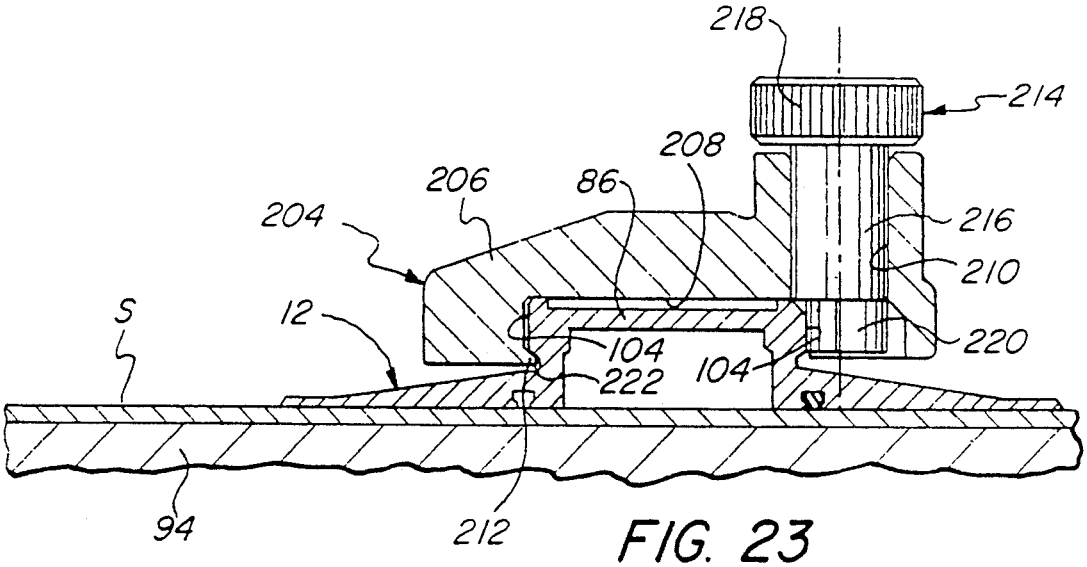
FIG. 23 is a sectional view taken along line 23—23 of FIG. 1 and drawn to an enlarged scale.

Turning finally to FIG. 23, therein illustrated in detail is a measuring stop device, generally designated by the numeral 204, suitable for use with the clamping bar assembly depicted. As can be seen, it is engaged upon the elevated, ruled portion 86 of the clamping bar and serves of course to restrict travel of the cutting head within measured distances therealong.

The stop device consists of a body 206 formed with a downwardly opening endwise channel 208, which is dimensioned and configured to slidably seat the device 204 upon the elevated portion 86 of the clamping bar. A circular hole 210 extends downwardly through the rearward side of the body 206, and a small lip element 212 extends inwardly of the channel 208 along the forward side. A locking piece, generally designated by the numeral 214, has a cylindrical shaft portion 216 rotatably seated in the hole 210, with a knurled head 218 at its upper end and a short cylindrical camming or gripping element 220 at its lower end. The gripping element 220 is eccentrically disposed with respect to the axis of rotation of the piece 214, and lies alongside the lateral surface 104 at the back of the elevated bar portion 86. With the lip element 212 engaged within the slot 222 that extends longitudinally beneath the opposite lateral surface 104, rotation of the locking piece 214 will bring the surface of the gripping element 220 into binding engagement with the adjacent lateral surface 104, securing the stop device 204 at a selected position along the length of the clamping bar.

As indicated above, the cutter can be used in various ways; e.g., seated on the track of the clamping bar assembly, run along the edge of a separate straightedge member, assembled with the template guide piece or, indeed, in a free-hand mode. Not only does the 180° inversion feature of the cutter enable ambidextrous use, as described, but moreover, by disposing the blade most remotely to the mat guide it permits cutting of margins that correspond to virtually the full width of the base (typically about 20 centimeters). Although the shiftable mounting of the mat guide may alone be relied upon for presenting an abutment edge irrespective of which side of the supporting base is employed, in may instances its removal and reversal may be found preferable. It will also be appreciated that the longitudinal notch on the inside surface of the mat guide is provided for Vee-grooving purposes, that a protective underlayment mat will normally be employed, and that numerous modifications may be made to the systems and components described without departure from the novel concepts hereof or from the scope of the claims appended hereto.

Thus, it can be seen that the present invention provides a novel support assembly that is suitable for use in association with sheet material cutters, in which the workpiece is effectively held against the supporting base and by which guide means, such as an elevated track, is quickly, conveniently and precisely located at a selected distance from a reference edge. In the assembly, a supporting base coacts with a spanning, elongate clamping member to securely and truly engage the latter in each of a multiplicity of precise positions at increments spaced along the opposite ends of the base, which base may be of a double-sided character to permit spacing of the clamping member at distances measured alternatively in both of two different systems (e.g., English and metric). The assembly is facile to use and is of relatively incomplex design and construction.

Having thus described the invention, what is Claimed is:

1. A support assembly for a sheet material workpiece, comprising:

a workpiece-supporting base having opposite side faces and opposite ends, and a planar support surface disposed on at least one of said faces between said opposite ends, said base comprising a planar board and a U-shaped rack member disengagably affixed to said board and providing one end of said base, said rack member comprising a central web portion and a pair of spaced flange portions extending over said faces of said base from said web portion, and said rack member having an array of numerous teeth thereon extending along said one end of said base, said array including first and second rectilinear sections in each of which sections said teeth are substantially identical to, and equidistantly spaced from, one another, said first rectilinear section being disposed more proximate said one of said base than the other of said opposite side faces thereof and being accessible from the plane of said support surface, and said second rectilinear section being disposed more proximate said other face than said one face; and an elongate clamping member removably affixed on said base and spanning said base from end-to-end, said clamping member having opposite end portions with engagement means thereon for engaging said ends of said base, said engagement means on at least one of said end portions comprising a part disposed in confronting relationship to said one section of said array of teeth and having a row of detent elements thereon aligned with said one section and configured and position to mesh with said teeth thereof, said detent elements being slidably engagable with said teeth of said one section from a position of said clamping member above said support surface, and said row of detent elements being substantially shorter than said one section, thus permitting said clamping member to be affixed on said base, by interengagement of said detent elements and teeth, in a multiplicity of locations spaced along said ends thereof.

2. The assembly of claim 1 wherein said base has a reference edge thereon perpendicular to the axis of said array section, and has a linear distance scale thereon extending along said one end and on a surface that is substantially coplanar with said support surface, said scale indicating distances from said reference edge; wherein said assembly additionally includes a locating device constructed to coact with said base and said clamping member to facilitate positioning of said clamping member relative to said base, said locating device and said base having interengageable affixing elements thereon constructed for affixing said locating device at each of a multiplicity of locations along said one end of said base, said affixing elements on said base comprising a row of equidistantly spaced apertures extending adjacent said distance scale, and said locating device comprising a body having a plurality of pin elements projecting in one direction therefrom and providing said affixing elements on said locating device, said pin elements being spaced and dimensioned for inserted into said apertures of said row, said locating device having a contact face thereon for engaging said clamping member positioned thereagainst.

3. The assembly of claim 2 wherein said base has an abutment member extending along said reference edge for abutment of an edge of a workpiece thereagainst.

4. The assembly of claim 1 wherein said base has a second planar support surface between said opposite ends on said other face, said array of teeth also being accessible from the plane of said second support surface.

5. The assembly of claim 1 wherein said base has an edge along said one end with structure extending generally perpendicularly to said support surface thereof, and wherein said clamping member comprises a clamping bar so spanning said base and having a substantially planar bottom surface, said part extending generally perpendicularly to said bottom surface and disposed in confronting relationship to said edge structure of said base.

6. The assembly of claim 5 wherein said first and second sections of said array extend parallel to one another along said edge structure of said base.

7. The assembly of claim 6 wherein said spacing between said teeth of said first section is different from said spacing between said teeth of said second section.

8. The assembly of claim 7 wherein said teeth of said first section are spaced at English system intervals, and wherein said teeth of said second section are spaced at metric system intervals.

9. The assembly of claim 8 wherein said detent elements are equidistantly space from one another with a center-to-center spacing of about 8 millimeters, or a small multiple thereof, for alternative engagement with said teeth of both of said sections of said array.

10. The assembly of claim 9 wherein both said teeth and also said detent elements are of pointed cross section.

11. The assembly of claim 5 wherein said base has a reference edge thereon perpendicular to said axes of said array sections, and has an abutment member extending along said reference edge for abutment thereagainst of an edge of a workpiece, said abutment member being movable across said reference edge in a direction perpendicular to said support surface.

12. The assembly of claim 1 wherein said each of said flange portions of said rack member has a linear distance scale thereon extending along said one end of said base, one of said scales being in English system increments and the other of said scales being in metric system increments.

13. The assembly of claim 12 additionally including a locating device constructed to coact with said base and said clamping member to facilitate positioning of said clamping member relative to said base, said locating device and said rack member having interengageable affixing elements thereon constructed for affixing said locating device at each of a multiplicity of positions along said one end of said base, said affixing elements on said rack member comprising two portions, one of which portions extends adjacent each of said distance scales, and said locating device having a contact face thereon for engaging said clamping member positioned thereagainst.

14. The assembly of claim 13 wherein said affixing elements on said rack member comprise two rows of spaced apertures, and wherein said locating device comprises a body having a multiplicity of pin elements projecting therefrom and providing said affixing elements thereon, one of said rows providing a first portion of said affixing elements on said rack member and being equidistantly spaced from one another in English system increments, the other of said rows providing a second portion of said affixing elements on said rack member and being equidistantly spaced from one another in metric system increments, and said pin elements being provided as two sets extending in opposite directions from said body, each set comprising at least two of said pin elements, said pin elements of one set being mutually spaced and dimensioned for insertion into said apertures of said one row, and the other set of said pin elements being mutually spaced and dimensioned for insertion into said apertures of said other row.

15. The assembly of claim 1 wherein another said array of teeth extends along the other of said ends of said base for such access, and wherein said engagement means on the other of said end portions of said clamping member comprises said part, said part on said other end portion being so configured and positioned as to be so engageable and to so mesh with said one section of said another array of teeth.

16. A support assembly for a sheet material workpiece, comprising:

a workpiece-supporting base having opposite ends and a planar support surface therebetween, said base having edge structure extending along at least one of said ends on the outer periphery of said base and generally perpendicular to said support surface thereof;

an array of numerous teeth extending along said one end of said base on said edge structure and accessible from the plane of said support surface, said array including at least one rectilinear section in which said teeth are substantially identical to, and equidistantly spaced from, one another; and an elongate clamping member removably affixed on said base and comprising a clamping bar having a substantially planar bottom surface and spanning said base from end-to-end, said clamping member having opposite end portions with engagement means thereon for engaging said ends of said base, said engagement means on at least of said end portions comprising a part extending generally perpendicularly to said bottom surface of said clamping bar and disposed in confronting relationship to said edge structure and to said one section of said array of teeth, said part having a row of detent elements thereon aligned with and confronting said one section and configured and positioned to mesh with said teeth thereof, at least one of all of said array and all of said detent elements of said row being elongated in a direction generally normal to said support surface of said base and said bottom surface of said bar, said detent elements being slidably engageable with said teeth of said one section from a position of said clamping member above said support surface, and said row of detent elements being substantially shorter than said one section, thus permitting said clamping member to be affixed on said base, by interengagement of said detent elements and teeth, in a multiplicity of locations spaced along said ends thereof.

17. The assembly of claim 16 wherein said part is adjustable on said clamping bar in a direction substantially normal to said base edge structure.

18. The assembly of claim 18 wherein said base comprises a planar board and a rack member affixed thereto, said rack member providing said one end of said base as well as said array of teeth along said one end, said rack member also providing an edge surface contiguous to said planar support surface for abutment of an edge of a workpiece thereagainst.

19. The assembly of claim 16 wherein another said array of teeth extends along the other of said ends of said base for such access, and wherein said engagement means on the other of said end portions of said clamping member comprises said part, said part on said other end portion being so configured and positioned as to be so engagable and to so mesh with said one section of said another array of teeth.

20. The assembly of claim 16 wherein both of all of said teeth and all of said detent elements are so elongated.

21. A support assembly for a sheet material workpiece, comprising:

a workpiece-supporting base having opposite ends and a planar support surface therebetween;

an array of numerous teeth extending along at least one of said ends of said base and accessible from the plane of said support surface, said array including at least one rectilinear section in which said teeth are substantially identical to, and equidistantly spaced from, one another; and an elongate clamping member removably affixed on said base and comprising a clamping bar having a substantially planar bottom surface spanning said base from end-to-end, and having an upper portion with guide means thereon for slidably engaging a cutter member for movement therealong, said guide means comprising an elevated central portion, extending from end-to-end on said bar, which is of effectively uniform cross section along its length, taken in planes to which the longitudinal axis thereof is normal, and said clamping member further comprising opposite end portions with engagement means thereon for engaging said ends of said base, said engagement means on at least one of said end portions comprising a part disposed in confronting relationship to said one section of said array of teeth and having a row of detent elements thereon aligned with said one section and configured and positioned to mesh with said teeth thereof, said detent elements being slidably engagable with said teeth of said one section from a position of said clamping member above said support surface, and said row of detent elements being substantially shorter than said one section, thus permitting said clamping member to be affixed on said base, by interengagement of said detent elements and teeth, in a multiplicity of locations spaced along said ends thereof.

22. The assembly of claim 21 wherein another said array of teeth extends along the other of said ends of said base for such access, and wherein said engagement means on the other of said end portions of said clamping member comprises said part, said part on said other end portion being so configured and positioned as to be so engagable and to so mesh with said one section of said another array of teeth.

* * * * *

UNITED STATES PATENT AND TRADEMARK OFFICE

CERTIFICATE OF CORRECTION

PATENT NO. : 5,271,305

DATED : December 21, 1993

INVENTOR(S) : Alan R. Peters et al

It is certified that error appears in the above-identified patent and that said Letters Patent is hereby corrected as shown below:

Claim 2, column 11, line 60 delete the word "inserted" and substitute therefor --insertion--.

Claim 16, column 13, line 36 delete the word "of" and substitute therefor --one--; same claim, line 44 after the word "said" (second occurence) insert --teeth of said--.

Claim 18, column 13, line 60, after the word "claim" delete the numeral "18" and substitute therefor --16--.

Signed and Sealed this

Seventeenth Day of May, 1994

Bruce Lehman

*Attest:*

BRUCE LEHMAN

*Attesting Officer*

*Commissioner of Patents and Trademarks*